US007268701B2

(12) United States Patent
Rohl

(10) Patent No.: US 7,268,701 B2
(45) Date of Patent: Sep. 11, 2007

(54) PORTABLE TRAFFIC SIGNALLING DEVICE

(76) Inventor: Bradley S. Rohl, Box 365, Oakbluff, Manitoba (CA) R0G 1N0

( * ) Notice: Subject to any disclaimer, the term of this patent is extended or adjusted under 35 U.S.C. 154(b) by 213 days.

(21) Appl. No.: 11/225,065

(22) Filed: Sep. 14, 2005

(65) Prior Publication Data

US 2006/0055558 A1 Mar. 16, 2006

Related U.S. Application Data

(60) Provisional application No. 60/610,177, filed on Sep. 16, 2004.

(51) Int. Cl.
*G08G 1/095* (2006.01)

(52) U.S. Cl. ..... 340/908; 340/907; 340/908.1; 116/63 R; 116/63 P; 40/612; 49/49

(58) Field of Classification Search ..... 340/907, 340/908, 908.1; 116/63 R, 63 P; 40/612; 49/49

See application file for complete search history.

(56) References Cited

U.S. PATENT DOCUMENTS 4,543,905 A 10/1985 McKenney
4,777,751 A 10/1988 Pasquale
4,992,788 A 2/1991 Arndt
5,257,020 A 10/1993 Morse
5,542,203 A * 8/1996 Luoma et al. ..... 340/908
6,374,524 B1 4/2002 Capps
6,812,856 B2 * 11/2004 Heinz et al. ..... 340/907
7,135,990 B2 * 11/2006 Richardson et al. ..... 340/908
7,155,850 B2 * 1/2007 Wilinsky et al. ..... 116/63 P

* cited by examiner

*Primary Examiner*—Jeffery Hofsass
*Assistant Examiner*—Samuel J. Walk
(74) *Attorney, Agent, or Firm*—Ryan W. Dupuis; Michael R. Williams; Adrian D Battison

(57) ABSTRACT

A portable traffic signalling device comprises a frame on wheels which supports an enclosed occupant compartment arranged to receive an occupant therein. The compartment is pivotal on the frame between an upright deployed position and a transport position lower in elevation than the deployed position. A traffic indicator is supported on the frame for directing vehicular traffic as controlled by the occupant of the compartment. The device permits a human operator to judge how to direct traffic within a safe environment. The use of a portable compartment with traffic indicators is safer than use of conventional flagpersons to temporarily direct traffic as the occupant of the device is less likely to be subject to fatigue and the like.

20 Claims, 9 Drawing Sheets

PORTABLE TRAFFIC SIGNALLING DEVICE

This application claims the benefit under 35 U.S.C. 119(e) of U.S. provisional application Ser. No. 60/610,177, filed Sep. 16, 2004.

FIELD OF THE INVENTION

The present invention relates to a portable device for receiving an occupant therein which includes traffic signalling equipment for directing traffic operated by the occupant.

BACKGROUND

When vehicular traffic routes are temporarily blocked due to construction or other obstacles requiring traffic to be redirected it is common place for a flag person to position himself adjacent the roadway well in advance of the obstacle to appropriately direct traffic by either indicating to passing vehicles to slow down or temporarily stop until the roadway is cleared. In many instances this requires the flag person to remain attentive for long periods of time outdoors possibly in the cold or subject to the elements, for example, heat, dust, wind, rain or snow. Fatigue also poses a threat due to potential accidents with oncoming traffic should the flag person lose his focus momentarily.

U.S. Pat. No. 5,257,020 to Morse, U.S. Pat. No. 4,992,788 to Arndt and U.S. Pat. No. 4,543,905 to McKenney disclose automated traffic signalling devices which remove a flag person from danger, but such automated systems cannot effectively replace the responsiveness to varying demands of traffic and road conditions that a human operator possesses and accordingly such systems are not suitable for replacement of a flag person at construction sites and the like.

U.S. Pat. No. 4,777,751 to Pasquale and U.S. Pat. No. 6,374,524 to Capps disclose further examples of a portable traffic signalling device in which all of the equipment used by a flag person including signs, flags, lights or radio communications can be carried on a single cart including a platform for the operator. The flag person however remains fully exposed to the elements and therefore is offered no protection whatsoever.

SUMMARY

According to one aspect of the present invention there is provided a portable traffic signalling device comprising:

a frame supported on wheels for rolling movement along the ground in a forward transport direction;

an enclosed occupant compartment supported on the frame arranged to receive an occupant therein;

a traffic indicator supported on the frame for directing vehicular traffic; and a controller which controls the traffic indicator and which is supported within the compartment for operation by the occupant.

The use of an occupant compartment including suitable interior controls for an external indicator visible by traffic permits a human operator to judge how to direct traffic without being exposed to the elements. The configuration as a result is safer as the occupant is less likely to be subject to fatigue and the like. In a preferred embodiment, the compartment is collapsible on a portable trailer for ready use alongside roadways and for subsequent transport and storage.

Preferably the compartment is supported on the frame for movement relative to the frame between a deployed position in which the compartment is upright and a transport position in which the compartment is lower in elevation than in the deployed position.

The compartment may be pivotally supported on the frame for movement about a respective pivot axis of the compartment between the deployed position and the transport position.

The pivot axis of the compartment is preferably located substantially parallel to and adjacent to a rear wheel axis of the frame in the forward transport direction.

Furthermore, the pivot axis of the compartment may be spaced upwardly above a floor of the compartment in the upright position.

When there are provided rear stabilizer jacks on the frame for engaging the ground, preferably the pivot axis of the compartment is longitudinally positioned between a wheel axle of the frame and the rear stabilizer jacks.

When the frame is elongate in the forward transport direction, the compartment may be pivotally supported on the frame about a lateral axis substantially perpendicular to the forward transport direction.

The compartment is preferably pivoted through a range of less than 90 degrees from the deployed position to the transport position so that the compartment extends at a slight upward incline from horizontal in the transport position for easing lifting of the compartment back into the deployed position.

A bottom end of the compartment is preferably supported below and rearwardly from a rear wheel axis of the frame in the deployed position.

The compartment may be displaced forwardly from the deployed position at a rear of the frame to the transport position adjacent a center of the frame.

There may be provided shock absorbers on the frame which engage the compartment as the compartment approaches the transport position.

The compartment preferably includes an internal support cage which is anchored to the frame in the deployed position.

The frame may include side rails extending rearwardly along opposing sides of the compartment to a rear of the compartment in the deployed position for receiving the compartment therebetween. A reinforced impact bar may also be provided for spanning laterally across the rear of the compartment.

Preferably a locking device is provided for securing the compartment in both the deployed and transport positions.

Preferably there is provided a rear facing window and at least one side window in the compartment. Ideally, windows are provided on all sides of the compartment.

There may be provided an auxiliary remote controller for controlling the traffic indicator remotely from the compartment.

The traffic indicator includes a gate arm which is pivotally supported on a front wall of the compartment for pivotal movement into a raised position extending substantially vertically upward along the front wall of the compartment. The gate arm is preferably pivotally supported on the compartment by selective fasteners which permit the gate arm to be selectively separated from the compartment.

In a preferred embodiment, the frame comprises a trailer frame including a hitch for connection to a towing vehicle.

Alternatively, the frame may comprise a truck frame of a truck including a driver cab at a front end and supporting the compartment at a rear end of the frame. There may be provided a linkage supporting the compartment on the truck frame for movement relative to the frame between a deployed position in which the compartment is upright and rearward of the truck frame and a transport position in which the compartment is lower in elevation than in the deployed position and is positioned ahead of the deployed position towards the front end of the truck.

BRIEF DESCRIPTION OF THE DRAWINGS

In the accompanying drawings, which illustrate exemplary embodiments of the present invention.

In the drawings like characters of reference indicate corresponding parts in the different figures.

DETAILED DESCRIPTION

Figure 1:
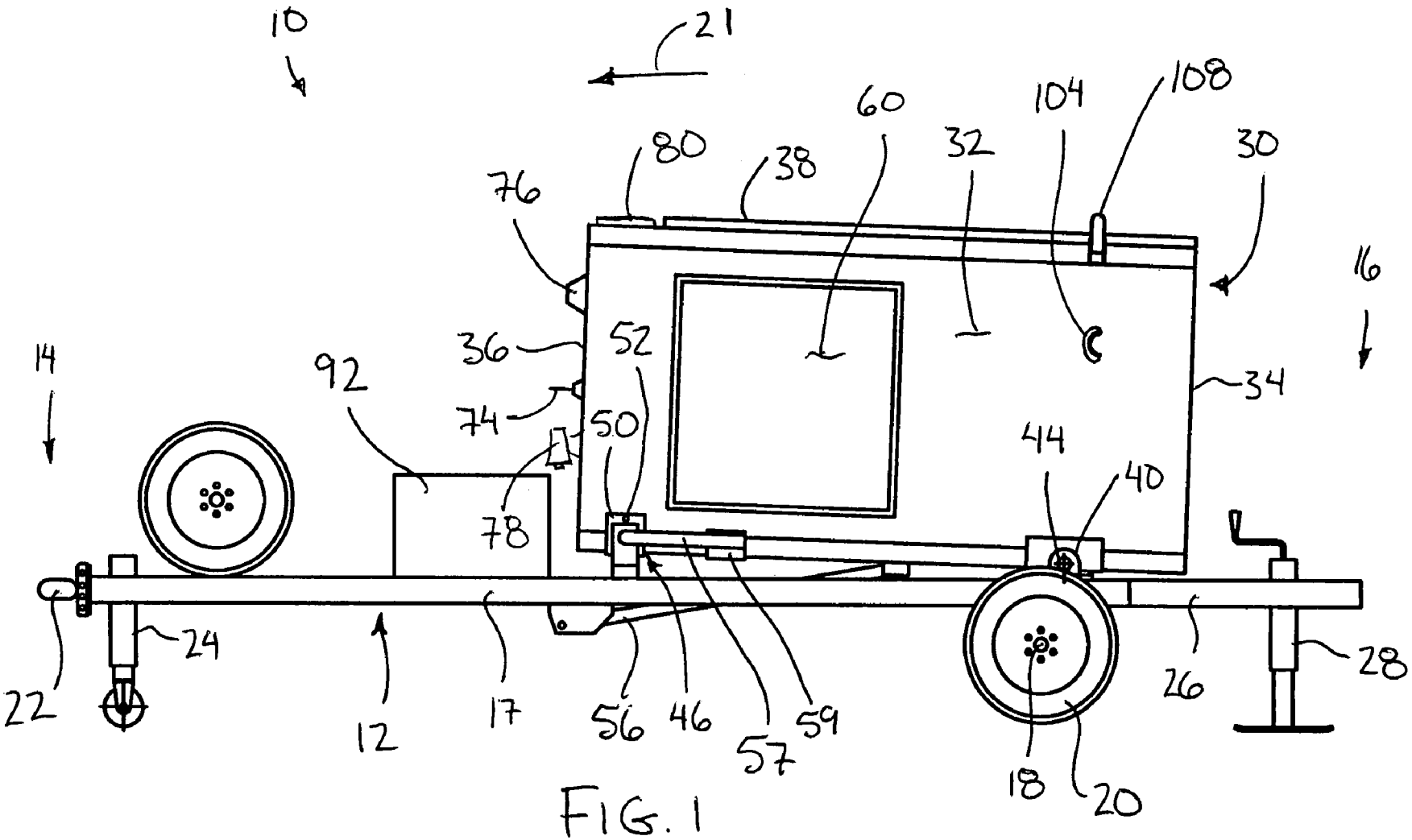
FIG. 1 is a side elevational view of a first embodiment of the portable traffic signalling device in a collapsed transport position.

Referring to the accompanying drawings, there is illustrated a portable traffic signalling device generally indicated by reference numeral 10. The device 10 is well suited for receiving an occupant such as a flag person for directing vehicular traffic, typically in temporary situations, for example when there is a temporary obstacle on the roadway including construction and the like.

Referring initially to FIGS. 1 through 9, a first embodiment of the device 10 is illustrated in which the device 10 includes a trailer frame 12 which is elongate in a longitudinal direction of rolling movement from the front end 14 to the rear end 16. The frame 12 includes two elongate side rails 17 which are supported parallel and spaced apart along opposing sides of the frame by suitable crossbars 19 at longitudinally spaced positions.

A wheel axle 18 is supported by bearings below the frame 12 to carry the frame on a pair of wheels 20 spaced apart on opposing sides of the frame 12 for rolling movement in a forward transport direction 21 corresponding to the longitudinal direction of the frame. The axle is positioned near to the rear end 16 opposite a hitch connector 22 extending from a neck at the front end 14. A rearward most one of the crossbars spans the rails near the wheel axle 18, with the rails extending rearwardly therebeyond.

A suitable hitch jack 24 is provided at the front of the frame adjacent the hitch connector 22. The hitch jack 24 includes a wheel at a bottom end thereof for supporting the front end of the frame for rolling movement along the ground. The hitch jack 24 is hydraulically actuated for raising and lowering the front end of the frame relative to the ground as desired.

Rear levelling jacks 28 are respectively provided on the rails of the frame adjacent the rear end so as to be spaced apart on opposing sides of the frame. The levelling jacks 28 are spaced rearwardly of the wheel axle 18 to prevent pivoting movement of the frame on the wheels when parked alongside a roadway. An external frame member 26 is mounted alongside each rail 17 parallel and spaced outwardly therefrom a spacing which corresponds to a width of the wheels 20. The rear levelling jacks 28 are each mounted between the respective rail 17 and the respective external frame member 26 for stably supporting the jack in relation to the frame.

Figure 2:
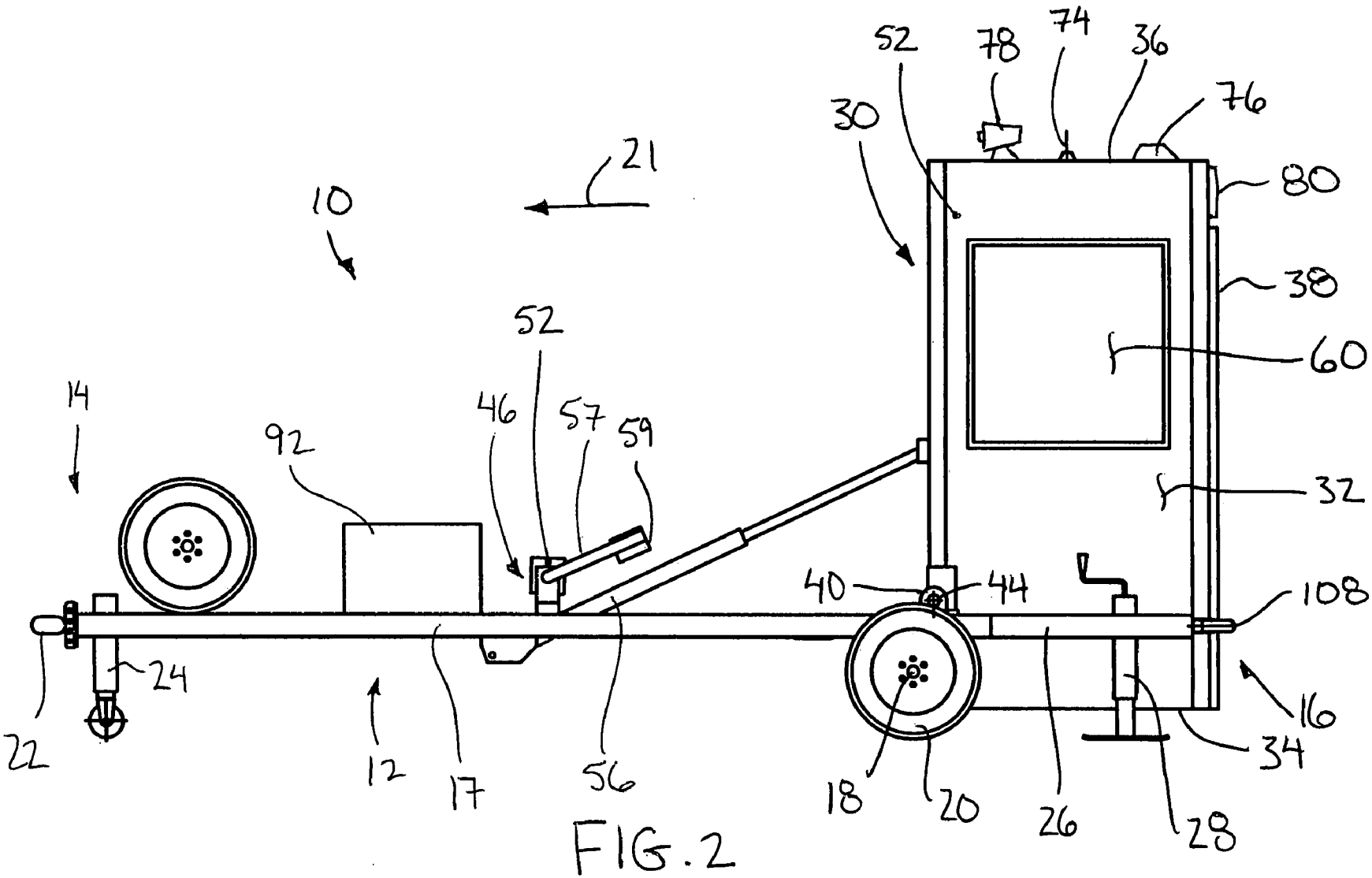
FIG. 2 is a side elevational view of the first embodiment of the device in an upright deployed position.
Figure 3:
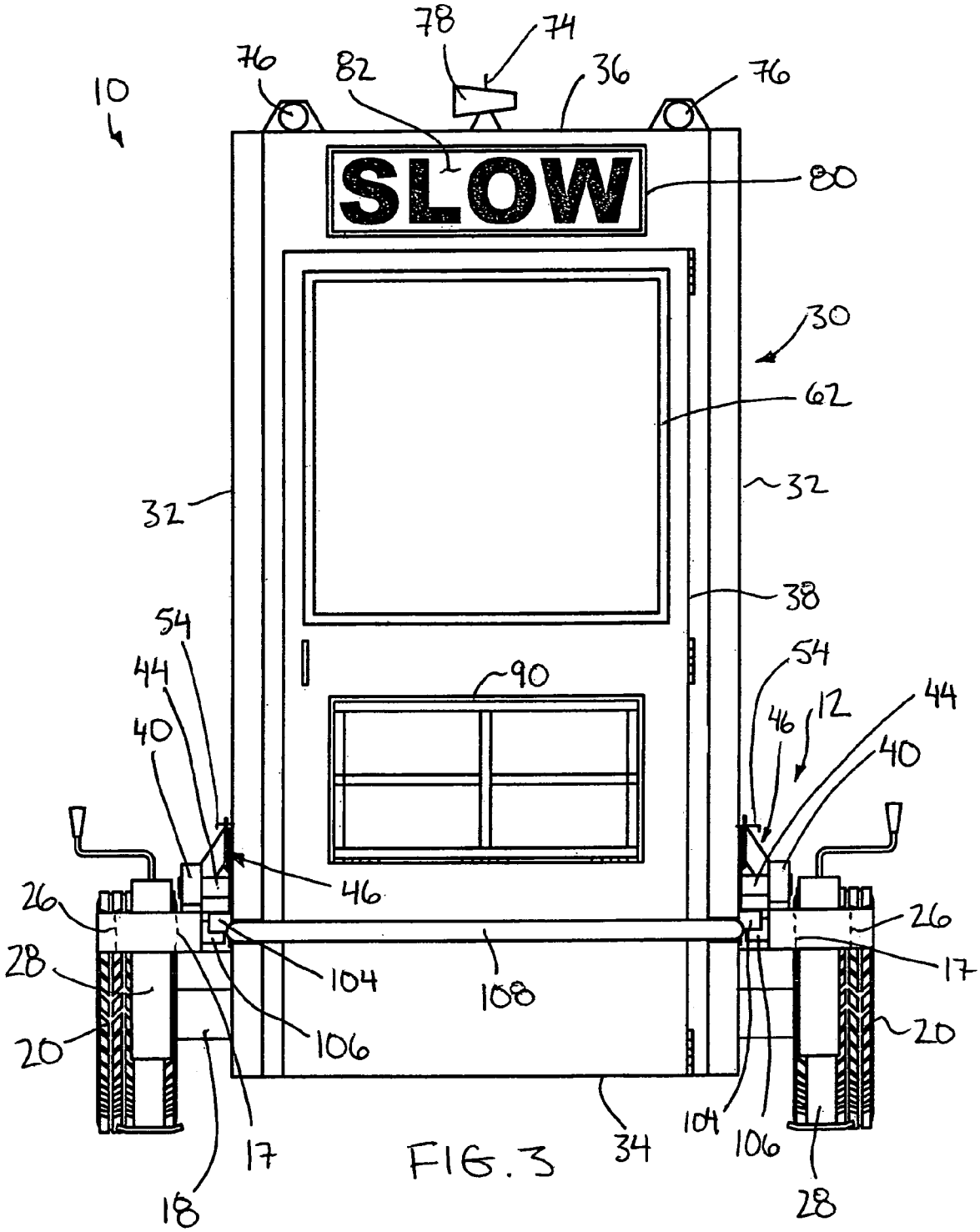
FIGS. 3 and 4 are rear elevational views of the first embodiment of the device in the deployed and transport positions respectively.
Figure 4:
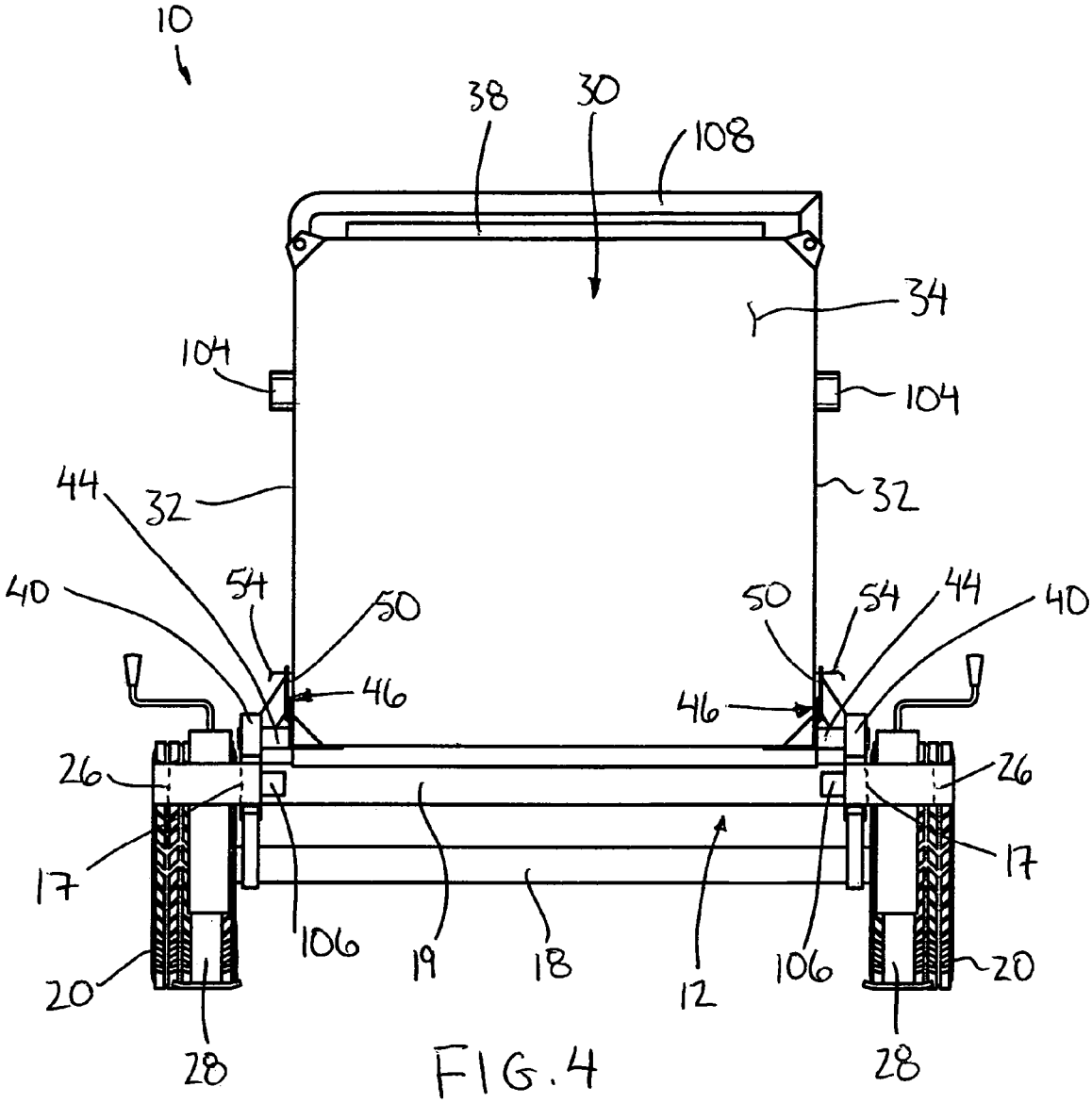
Figure 5:
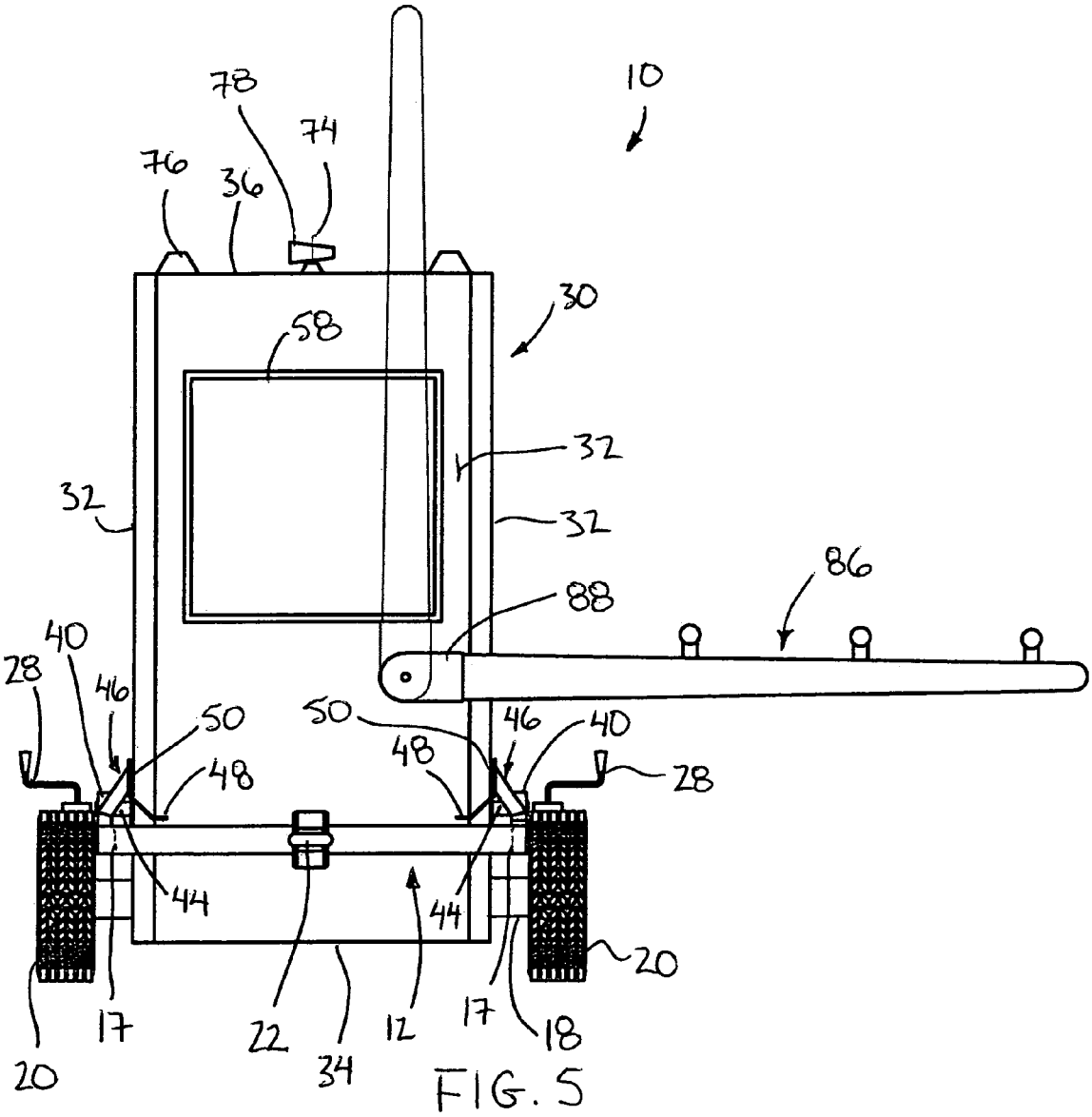
FIG. 5 and FIG. 6 are front elevational and plan views of the first embodiment of the device in the deployed position.
Figure 6:
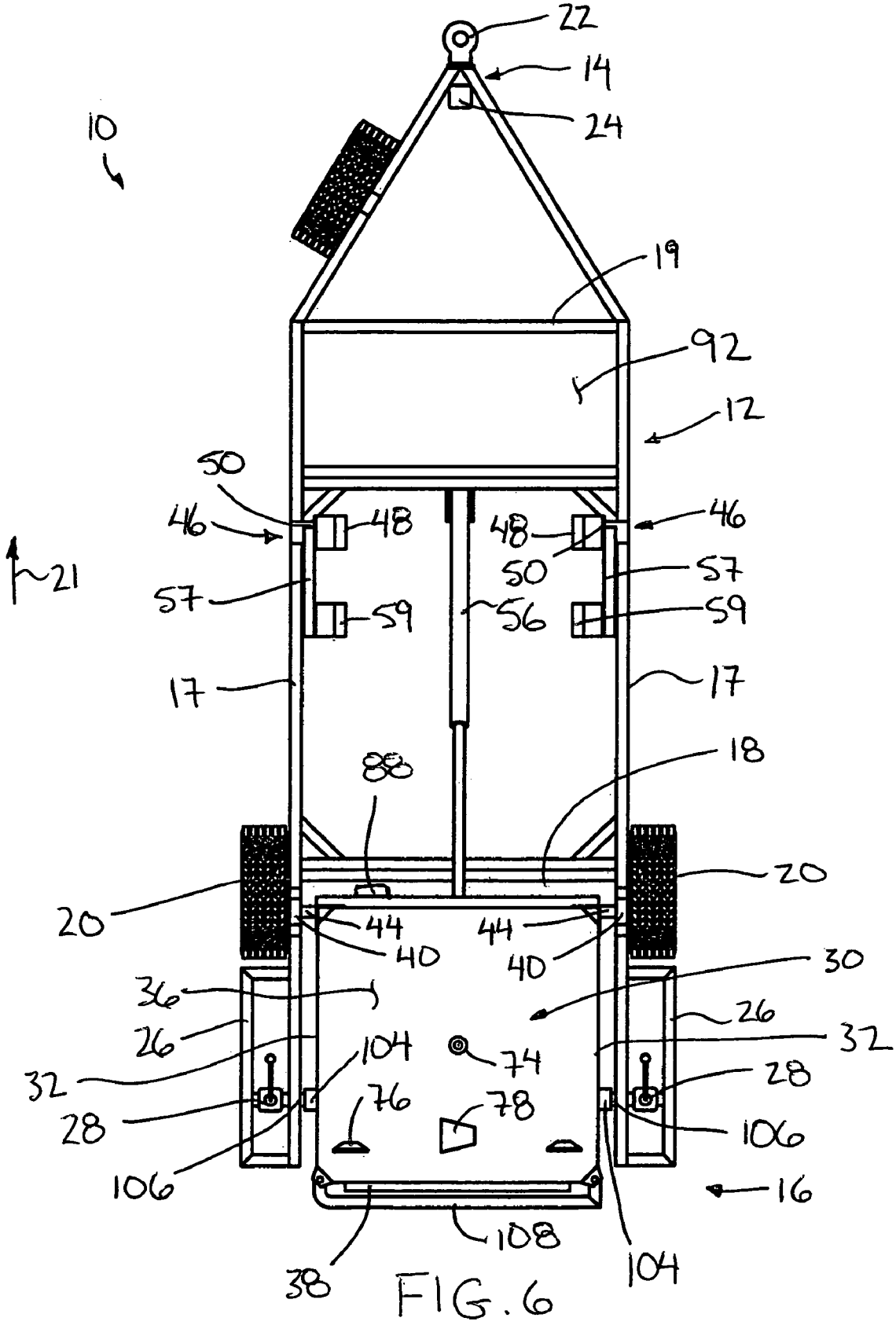
Figure 8:
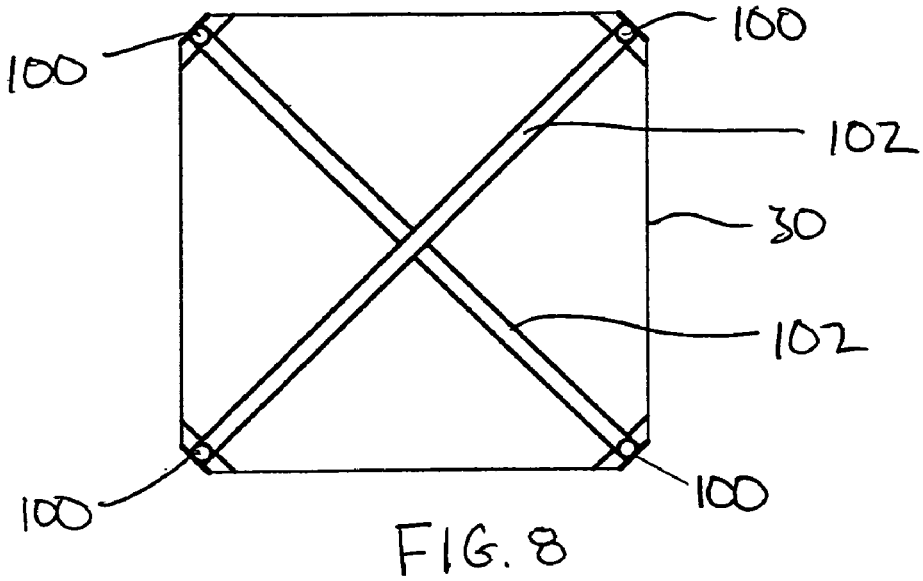
FIG. 8 is a bottom plan view of the compartment of FIG. 7.
Figure 7:
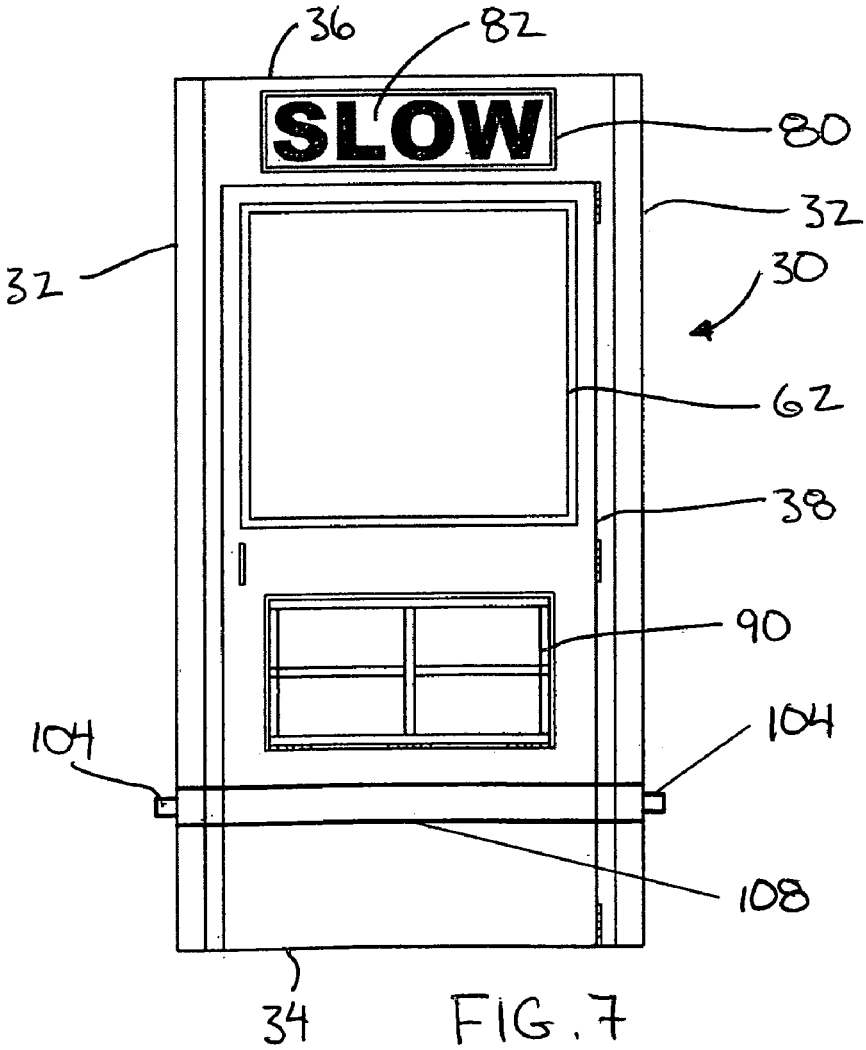
FIG. 7 is a rear elevational view of the compartment of the device according to FIG. 1, shown separated from the frame.

An occupant compartment 30 is pivotally supported on the frame between an upright deployed position as shown in FIG. 2 and a transport position as shown in FIG. 1 in which the compartment is lowered and collapsed so as to be lower in profile and in elevation than in the upright deployed position. The compartment 30 in the deployed position is tall and narrow having four side walls 32, a floor 34 and a roof 36 to fully enclose the compartment and protect the occupant therein from the elements. A door 38 is provided in a rear facing one of the side walls 32 suitable for entry and exit of a person from the compartment.

Two pivot mounts 40 are mounted on opposing rails 17 of the frame for pivotally supporting pivot shafts 44 fixed on opposing side walls of the compartment thereon so that the compartment is received between the rails 17 of the frame in the deployed position. The pivot mounts 40 and pivot shafts 44 received therein define a common pivot axis of the compartment extending therebetween, horizontally across the front wall 32, perpendicular to the forward direction and spaced up from the bottom floor 34 when the compartment is in the deployed position. In the longitudinal direction of the frame, the axis of the pivot shaft is almost directly above, but spaced slightly rearwardly from the rear wheel axis so that weight of the compartment is substantially balanced on the wheels throughout pivoting movement of the compartment between the two positions.

The pivot mounts are spaced above the ground on the frame a spacing which is slightly greater than a spacing of the pivot shafts 44 from the bottom floor 34 of the compartment so that the compartment is suspended spaced above the ground in the deployed position.

In this configuration the compartment is supported substantially at the rear of the trailer frame in the deployed position. Movement of the compartment into the transport position involves pivoting the compartment forwardly through less than 90 degrees such that the full height comprising the longest dimension in the deployed position extends in the longitudinal direction of the trailer substantially horizontally in the transport position, but at a slight upward incline of a few degrees to ease lifting of the compartment back into the deployed position.

A cradle is supported on the frame adjacent the front end for supporting the top end of the compartment in the transport position. The cradle includes two guides 46 spaced apart from one another on opposing side rails 17 sufficiently for receiving the width of the compartment therebetween. Each guide 46 includes a supporting flange 48 extending inwardly towards the opposing guide, upon which the front wall of the compartment rests in the transport position. Each guide further includes a side flange 50 which extends upwardly, substantially perpendicularly to the supporting flange, so that the side flanges 50 face one another and extend along opposing parallel side walls of the compartment in the transport position.

Co-operating apertures 52 are provided in the side flanges 50 and the side walls of the compartment so that a suitable pin locking member 54 can be slidably received therethrough which acts to retain the compartment between the guides 46.

A hydraulic lifting actuator 56 is coupled between the frame at a location forwardly of the cradle and the front wall of the compartment partway between the top and bottom ends for raising and lowering the compartment between the deployed and transport positions. The hydraulic lift includes a suitable locking element to lock the lift in a fully extended position in which the compartment is in the deployed position to prevent accidental actuation of the compartment from the deployed position to the transport position when occupied.

The actuator 56 is a linear actuator which is anchored on the frame at a location spaced below the height of the pivot mounts 40 so as to be lower in elevation than the pivot axis. The connection of the actuator to the front wall of the compartment remains higher in elevation than the pivot axis even when the compartment is in the transport position due to the slight upward incline of the compartment from the bottom end to the top end in the transport position. Accordingly, a vertical differential in elevation is maintained between the mounting locations of the actuator on the frame and on the compartment to ease lifting of the compartment when the linear actuator is extended to return the compartment to the deployed position.

Each of the guides 46 of the cradle includes a shock absorber for engaging the front wall of the compartment adjacent the top end thereof as the compartment approaches the transport position from the deployed position. Each shock absorber comprises a torsion arm 57 pivotally supported on the respective guide 46 about a common horizontal axis oriented perpendicularly to the forward transport direction. In a relaxed position, the torsion arms 57 extend rearwardly at an upward incline to respective receiving flanges 59 and the free ends thereof. The receiving flanges 59 extend laterally inward towards one another for engaging the front wall of the compartment as the compartment is lowered. In the relaxed position, the receiving flanges 59 are higher in elevation than the supporting flanges 48 of the guides so that they are first engaged by the compartment. Lower of the compartment fully into the transport position in engagement with the supporting flanges 48 thus require pivoting of the torsion arms about their axis which eases the compartment into the transport position. The biasing force applied to the compartment by the torsion arms also provides some assisting to the lift actuator in initially raising the compartment back into the deployed position.

The compartment includes a front window 58 in the front wall, side windows 60 facing both the roadway in the side wall nearest the roadway and away from the roadway in the opposite side wall, and a rear window 62 in the door 38 in the rear wall of the compartment.

Figure 9:
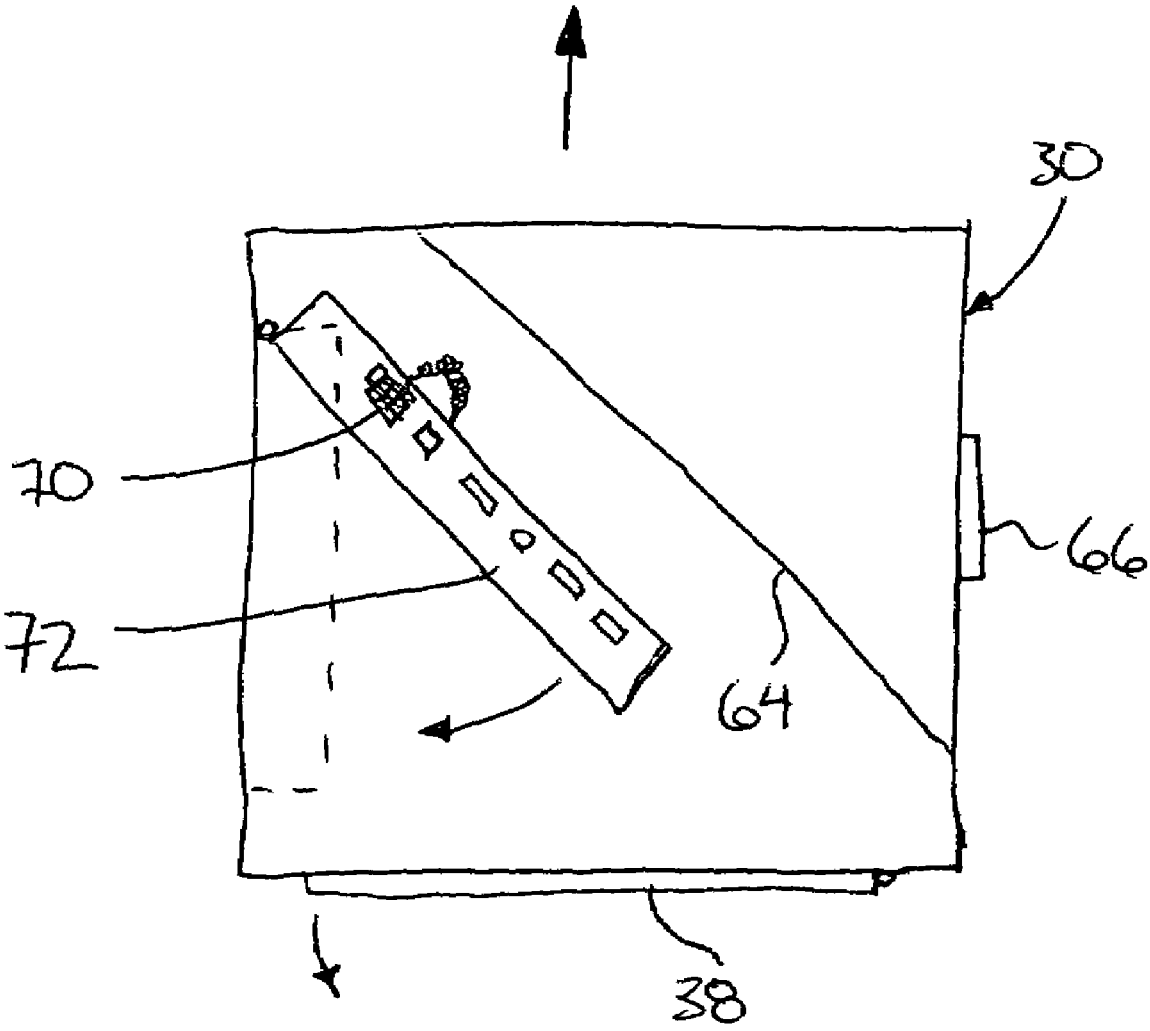
FIG. 9 is a schematic top plan view of an interior of the compartment.

As shown schematically in FIG. 9, the interior of the compartment includes a suitable seating area 64 upon which the occupant can sit. The seating area is oriented in an ergonomically acceptable manner while maintaining clear visibility of the roadway or work area. The seating area in the illustrated embodiment faces rearward and laterally towards traffic at a 45 degree incline to the forward direction so that an occupant seated thereon faces both rearward and towards the roadway. The compartment may also include a heater 66 to maintain the interior at suitable temperatures even in colder climates with an associated ventilation fan and/or air conditioning to prevent excess heat build-up in warmer climates. A two-way radio 70 is also provided within the compartment to maintain communication of the operator with persons responsible for the roadway obstacle such as a construction crew. Suitable controls for operating various traffic indicator equipment is supported on a control panel 72 pivotally mounted on a side wall of the compartment opposite the seating area 64 to adjust location of the controls relative to the operator on the seating area 64. Alternatively, the controls for the various traffic indicator equipment comprises a remote for use externally from the compartment.

Externally, the compartment includes a suitable antenna 74 on the roof for radio communication, warning lights 76 to ensure that the device as well seen by vehicular traffic in poor weather or poor lighting conditions and a speaker 78 connected to an internal intercom system for providing direction to persons outside the compartment.

The traffic indicator equipment includes an indicator panel 80 having a display surface 82 facing rearward. The panel 80 is fixedly mounted on the rear wall of the compartment spaced above the door 38. The display surface 82 includes a written message or simply bright warning colours and lighting which can all be changed or adjusted by the occupant within the compartment using the control panel 72 therein.

The traffic indicator equipment further includes a gate arm 86 which is carried by a socket 88 pivoted on the front wall of the compartment opposite the door at the rear wall. The socket slidably receives an inner end of the elongate gate arm 86 therein for movement with the socket between an activated position extending substantially horizontally and laterally outward towards the lanes of traffic or roadway and a raised position pivoted approximately 90 degrees to extend upward.

The internal end of the arm is tapered for ease of insertion into the socket 88 within which it is received. Suitable retainer pins or bolts are provided for retaining the arm within the socket. The arm 86 includes a plurality of lights and various other warning devices secured thereto at spaced positions in the longitudinal direction of the arm. The lights and pivotal movement of the gate arm are synchronized with various messages on the display surface of the indicator panel so that the two components can be operated together by the interior controls 72 or by external remote.

A fold down seat 90 may be hinged on the outer side of the door 38 of the compartment to permit the occupant to be seated externally of the compartment if desired in more desirable climates. The controls for the various traffic indicator equipment are operated using the external remote in this instance.

A housing 92 is provided at the front of the frame spaced ahead of the cradle sufficiently for receiving the compartment in the transport position rearwardly of the housing 92. The housing 92 has multiple access panels for receiving and maintaining an electric generator, a battery and hydraulic equipment driven by an electric motor receiving power from the generator for operating the hydraulic lift actuator so that the device 10 is a stand alone unit in which all of the systems thereof can be operated by the equipment within the housing 92.

For added safety and protection of the occupant within the compartment 30, an internal cage maybe provided in the form of reinforced frame members 100 comprising tubular steel. The frame members 100 are mounted vertically at each of the interior four corners of the compartment. The corner post frame members 100 are joined by crossed braces 102 extending diagonally across opposing corners at both the floor and roof of the compartment 30. The frame members and braces together form a reinforced cage about the occupant for protection against vehicular impacts.

Anchors 104 are provided on the exterior side walls of the two opposing lateral sides of the compartment for connection to the frame 12. Each anchor 104 is connected to the frame members 100 by suitable reinforcing members. Each anchor generally comprises on inverted cup shape having an open bottom which receives a frame lug 106 therein when the cup is lowered downwardly over top of the lug. The lugs 106 project inwardly from the opposing side rails 17 of the frame in longitudinal alignment with the anchors 104. The anchors 104 remain fixed on the compartment for movement therewith between the deployed position and the transport position while the lugs 106 on the frame are fixed in relation to the frame. In this configuration as the compartment is lowered into the deployed position, the anchors 104 are aligned with the respective lugs 106 to receive the lugs therein through the open bottom of the anchors. Once in the deployed position, the anchors 104 fully surround the respective lugs so that a horizontal impact distributes forces applied to the cage through the lugs and into the frame of the device 10. The open bottom of the anchors 104 permit the anchors to be simply lifted up off of the lugs 106 upon returning the compartment to the transport position.

An impact bar 108 is mounted across the rear side of the compartment to extend between the frame members 100 mounted in the two rear most corners of the compartment. The impact bar 108 is oriented substantially horizontally at the height of the frame 12 which corresponds approximately to the height of the wheels and the height of a typical passenger vehicle bumper. The impact bar 108 is hinged on one of the frame members 100 at the same side as the hinges of the door 38, while being similarly latched at the opposing side to the other rear frame member 100. The impact bar 108 may be latched independently or in cooperation with the door 38. When a vehicle collides with the rear of the device 10 in the deployed position, the impact force is distributed by the impact bar 108 to opposing sides of the internal cage which subsequently distributes force through the anchors 104 and lugs 106 into the frame so that the entire device 10 is displaced across the ground prior to collapsing of the compartment occurring.

In operation, the device is towed to a site by a suitable towing vehicle having hitch to which the hitch connector of the device is attached. The jacks are used to unhitch the trailer frame from the towing vehicle and to set the frame level on the ground. The locking pins are thus removed for releasing the compartment from the transport position and the compartment is lifted into the deployed position using the hydraulic lift actuator 56. The compartment pivots about the pivot shaft which is spaced between the axle and the rear jacks for balancing the frame and stably supporting the compartment during lifting. Once in the upright deployed position, the hydraulic lift is locked to prevent accidental return to the transport position. An occupant thus opens the door, enters the compartment, closes the door and then subsequently controls the traffic indicator equipment from within the safe interior and controlled environment of the compartment. The reverse processes are accomplished for returning the device into the transport position.

The device according to the present invention provides a form of shelter and refuge to provide safety from the elements to a flag person including safety from heat, cold, wind, rain, snow, sun and bugs etc. whether it be intermittently or continuously during the duration of the work day. The device serves as well to keep the operator or flag person alert and attentive to create a safer environment for those under the flag person's direction. The device further enhances visibility of the flag person's station and position to approaching traffic so that the traffic is alerted and aware that they are entering an area under the control of a flag person. The device is particularly useful in that it is a complete system that can be easily transported and quickly set up on site whether it be for an emergency situation or the daily setup and takedown where such flagging control is required. The device may also be used to provide an environment or means of sanitation where otherwise this would not be available without relief or temporary substitution from another flag person.

The wheel at the bottom of the hitch jack 24 readily permits the device to be rolled along the ground in a fully deployed position of the compartment. The device 10 can thus keep pace with a moving worksite along a roadway for example.

The configuration of the frame is such that the compartment is always stable whether in the transport or deployed positions. The location of the pivot adjacent the rear axle minimizes stress on the jacks and promotes balance to the trailer frame. The hydraulic lift actuator is preferably anchored between the compartment and the trailer frame at a laterally central location connected to a cross bar of the frame to avoid unnecessary twisting during lifting operations. Spacing of the pivot shaft above the bottom of the compartment and the location of the cradle adjacent the front end of the trailer frame further promote controlled movement and stable support of the compartment in either position. The hydraulic lift actuator may also be replaced with a gearbox and motor driven gears at the pivot shafts to control pivotal displacement of the compartment between the deployed and transport positions.

Most importantly, the device provides a safe environment for an operator both from the elements and from vehicular or construction traffic. While in work mode, the trailer acts as a safety barrier to potential hazards from work vehicles which might otherwise cause death or injury to a flag person. The structure of the device is also likely to reduce risk of injury from oncoming impacts.

In further embodiments, the windows may be provided with motorized wipers to maintain visibility during rain or snow conditions. Another optional feature includes a holder on the side of the trailer or on the side of the compartment to place a flag person's slow and stop paddle when they are in the enclosure of the compartment. The holder is positioned such that it does not obscure the warning lights and stop arm when in use and at the same time allows the operator instant access to the sign as soon as they exit the enclosure. Accordingly the sign preferably sits parallel to the side wall of the compartment close to the door opening. A pull-out step on the bottom of the enclosure may also be provided to ease stepping out of the enclosure where the grade slope is substantial. In the illustrated embodiment, the traffic indicator devices are orientated for roadways with traffic on the right hand side so that the enclosure can be supported on the right side of the road however a mirror image can readily be made available for operation in the opposing side of the road for lefthand traffic.

Figure 10:
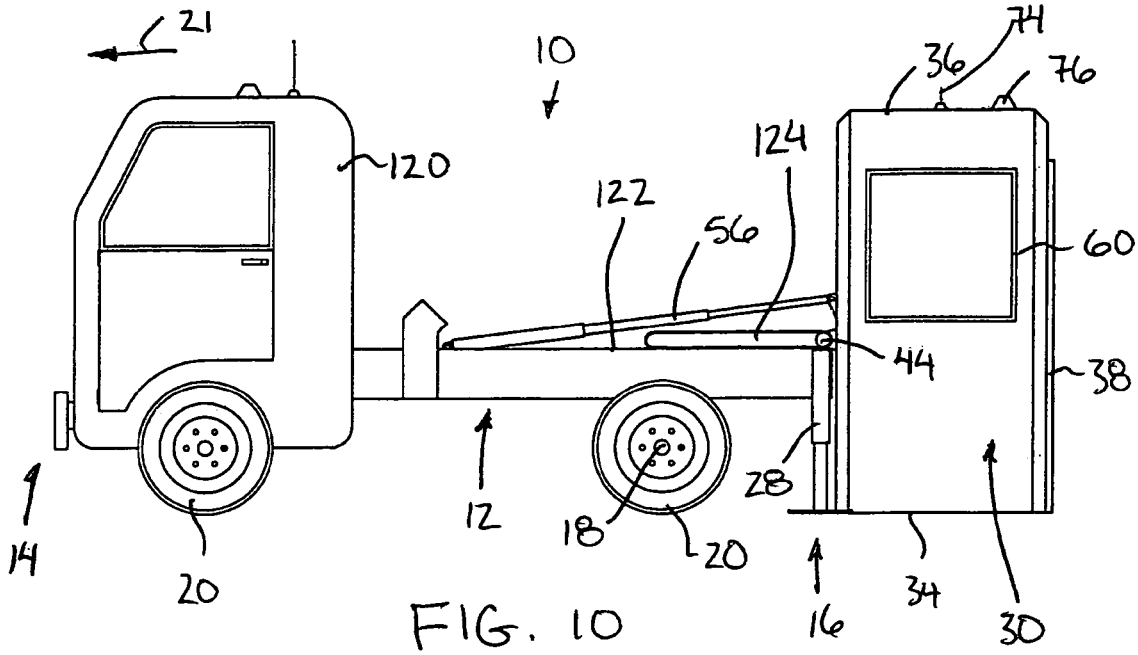
FIG. 10 and FIG. 11 are side elevational views of a second embodiment of the portable traffic signalling device in a deployed position and a transport position respectively.
Figure 11:
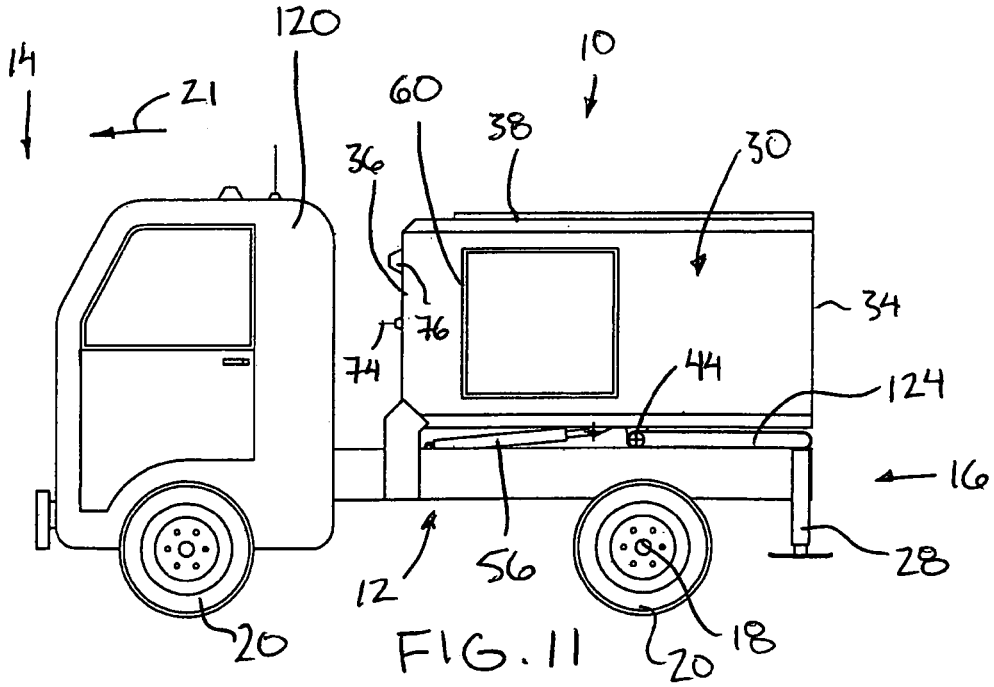

Turning now to FIGS. 10 and 11, a second embodiment of the device 10 is illustrated in which the frame 12 comprises a truck frame supported on wheels 20 for movement in the forward transport direction 21. The truck includes an operator cab 120 supported at the front end 14 of the frame while the compartment 30 is similarly supported at the rear end 16 of the frame. A deck 120 is provided at the rear of the truck for supporting the compartment 30 thereon in the transport position. The deck extends rearwardly in the longitudinal direction or forward transport direction a distance which corresponds approximately to the height of the compartment 30.

In the second illustrated embodiment, the pivot shafts 44 have a common pivot axis which is spaced forwardly of the front wall of the compartment in the deployed position. The pivot shafts are slidably received in tracks 124 extending in the longitudinal direction along opposing sides of the deck 122 of the truck. The tracks extend from approximately the middle of the deck to the rear of the deck a distance which corresponds approximately to the height of the pivot axis from the bottom of the compartment and a height of the track from the ground. In the second embodiment the linear actuator 56 comprises a multistage actuator coupled between a front of the deck 122 and a central location on the front wall between the top and bottom ends of the compartment in the deployed position. The actuator 56 is anchored to the wall spaced above the pivot axis of the wall. When in the deployed position, the pivot shafts are positioned at the rearmost ends of the track 124 with the compartment being fully reward of the truck frame in an upright orientation with the actuator 56 fully extended. To displace the compartment to the transport position, the actuator 56 is retracted which initially causes the compartment to be rotated through approximately ninety degrees upwardly and forwardly due to the mounting location of the actuator on the wall being higher in elevation than the pivot axis. Once the compartment reaches a near horizontal position, the bottom of the compartment is higher in elevation than the tracks 124 so that sufficient clearance is provided for permitting the compartment to be slidably displaced forwardly. Continued contraction of the actuator 56 causes the pivot shafts to be displaced from the rearward most ends of the tracks 124 to the forward most ends of the tracks. In this matter the compartment is positioned in the transport position in which the compartment is fully ahead of the deployed position of the compartment as well as being fully ahead of the rear end of the frame 12. When returning to the deployed position, extension of the actuator 56 first causes the pivot shafts to be displaced rearwardly to the rear ends of the tracks 124 and horizontal pivoting is prevented by abutment of the front wall of the compartment with the rear ends of the tracks 124. Once the rear ends of the tracks are reached, gravity assists in pivoting the bottom end of the compartment down and the top end of the compartment is thus pivoted upwardly and rearwardly with continued extension of the actuator until the upright deployed position of FIG. 10 is reached. All of the features with regard to the traffic indicating equipment and the controls therefore in the second embodiment are substantially identical to the first embodiment described above.

While some embodiments of the present invention have been described in the foregoing, it is to be understood that other embodiments are possible within the scope of the invention. The invention is to be considered limited solely by the scope of the appended claims.

The invention claimed is:

1. A portable traffic signalling device comprising:

a frame supported on wheels for rolling movement along the ground in a forward transport direction;

an enclosed occupant compartment supported on the frame for receiving an occupant therein;

a traffic indicator supported on the frame for directing vehicular traffic; and a controller which controls the traffic indicator and which is supported within the compartment for operation by the occupant.

2. The device according to claim 1 wherein the compartment is supported on the frame for movement relative to the frame between a deployed position in which the compartment is upright and a transport position in which the compartment is lower in elevation than in the deployed position.

3. The device according to claim 2 wherein the compartment is pivotally supported on the frame for movement about a respective pivot axis of the compartment between the deployed position and the transport position.

4. The device according to claim 3 wherein the compartment is pivoted through a range of less than 90 degrees from the deployed position to the transport position.

5. The device according to claim 3 wherein the pivot axis of the compartment is located substantially parallel to and adjacent to a rear wheel axis of the frame in the transport direction.

6. The device according to claim 3 wherein the pivot axis of the compartment is spaced upwardly above a floor of the compartment in the deployed position.

7. The device according to claim 3 wherein there is provided rear stabilizer jacks on the frame for engaging the ground and wherein the pivot axis of the compartment is longitudinally positioned between a wheel axle of the frame and the rear stabilizer jacks.

8. A device according to claim 2 wherein the frame is elongate in the forward transport direction and the compartment is pivotally supported on the frame about a lateral axis substantially perpendicular to the forward transport direction.

9. The device according to claim 2 wherein a bottom end of the compartment is supported below and rearwardly from a rear wheel axis of the frame in the deployed position.

10. The device according to claim 2 wherein the compartment is displaced forwardly from the deployed position at a rear of the frame to the transport position adjacent a center of the frame.

11. The device according to claim 2 wherein there is provided shock absorbers on the frame which engage the compartment as the compartment approaches the transport position.

12. The device according to claim 2 wherein the compartment includes an internal support cage which is anchored to the frame in the deployed position.

13. The device according to claim 2 wherein the frame includes side rails extending rearwardly along opposing sides of the compartment in the deployed position.

14. The device according to claim 13 wherein the side rails extend rearward to a rear of the compartment in the deployed position and wherein there is provided a reinforced impact bar spanning laterally across the rear of the compartment.

15. The device according to claim 2 wherein there is provided a locking device for securing the compartment in the both the deployed position and the transport position.

16. The device according to claim 1 wherein there is provided a rear facing window and at least one side window in the compartment.

17. The device according to claim 1 wherein the traffic indicator includes a gate arm which is pivotally supported on a front wall of the compartment for pivotal movement into a raised position extending substantially vertically upward along the front wall of the compartment, the gate arm being supported on the compartment by selective fasteners permitting the gate arm to be selectively separated from the compartment.

18. The device according to claim 1 wherein there is provided an auxiliary remote controller for controlling the traffic indicator remotely from the compartment.

19. The device according to claim 1 wherein the frame comprises a truck frame of a truck including a driver cab at a front end and supporting the compartment at a rear end of the frame.

20. The device according to claim 1 wherein there is provided a linkage supporting the compartment on the frame for movement relative to the frame between a deployed position in which the compartment is upright and rearward of the truck frame and a transport position in which the compartment is lower in elevation than in the deployed position and is positioned ahead of the deployed position towards the front end.

* * * * *